US011542703B2

(12) United States Patent
Crenshaw

(10) Patent No.: US 11,542,703 B2
(45) Date of Patent: Jan. 3, 2023

(54) CORNER ASSEMBLY

(71) Applicant: MFPHD, LLC, Lorena, TX (US)

(72) Inventor: Thomas Crenshaw, Lorena, TX (US)

(73) Assignee: mfPHD, LLC, Lorena, TX (US)

( * ) Notice: Subject to any disclaimer, the term of this patent is extended or adjusted under 35 U.S.C. 154(b) by 0 days.

(21) Appl. No.: 17/401,036

(22) Filed: Aug. 12, 2021

(65) Prior Publication Data

US 2021/0372119 A1 Dec. 2, 2021

Related U.S. Application Data

(63) Continuation of application No. 16/677,449, filed on Nov. 7, 2019, now Pat. No. 11,098,477.

(60) Provisional application No. 62/757,610, filed on Nov. 8, 2018.

(51) Int. Cl.

| | |
|---|---|
| ***E04B 1/38*** | (2006.01) |
| ***E04B 2/78*** | (2006.01) |
| ***E04B 2/74*** | (2006.01) |
| ***E04B 1/61*** | (2006.01) |

(52) U.S. Cl.

CPC ..... *E04B 1/38* (2013.01); *E04B 2/78* (2013.01); *E04B 2001/6195* (2013.01); *E04B 2002/7498* (2013.01)

(58) Field of Classification Search

CPC ..... E04B 1/38; E04B 2/78; E04B 2001/6195; E04B 2002/7498

See application file for complete search history.

(56) References Cited

U.S. PATENT DOCUMENTS

| | | | |
|---|---|---|---|
| 1,918,228 | A | 7/1933 | Spencer |
| 2,851,134 | A | 9/1958 | Robinson, Jr. |
| 3,906,696 | A | 9/1975 | Poter et al. |
| 3,989,397 | A | 11/1976 | Baker |
| 4,122,203 | A | 10/1978 | Stahl |
| 4,477,201 | A | 10/1984 | Yoshiyuji |
| 5,297,370 | A | 3/1994 | Greenstreet et al. |
| 5,592,786 | A | 1/1997 | Kamm |
| 5,816,003 | A | 10/1998 | Larsson et al. |
| 6,070,377 | A | 6/2000 | Guevara Guzman |
| 6,792,727 | B2 | 9/2004 | Krieger |
| 7,303,358 | B1 | 12/2007 | Fuller |

(Continued)

FOREIGN PATENT DOCUMENTS

| | | | |
|---|---|---|---|
| CN | 102383507 | A | 3/2012 |
| CN | 110439204 | A | 11/2019 |

(Continued)

OTHER PUBLICATIONS

"Nexor Modular Cladding", Nexor, pp. 1-11, https://meditek.no/wp-content/uploads/2018/10/NEXOR-Cladding-rev.01-min.pdf, Last accessed Apr. 9, 2021.

(Continued)

*Primary Examiner* — Andrew J Triggs

(74) *Attorney, Agent, or Firm* — Patterson + Sheridan, LLP

(57) ABSTRACT

A monolithic corner encapsulates one or more panels while maintaining structural integrity and maintain hygienic properties. The corner may securely receive one or more panels and provide flexibility to easily adjust the one or more panels. The corner may simplify installation and an ability to adjust connected panels without compromising safety, installation time, and sterility.

20 Claims, 1 Drawing Sheet

(56) References Cited

U.S. PATENT DOCUMENTS

| | | | | |
|---|---|---|---|---|
| 7,805,899 | B2 | 10/2010 | Montgomery | |
| 8,033,066 | B2 | 10/2011 | Griffiths | |
| 8,063,116 | B2 | 11/2011 | Trogolo et al. | |
| 8,245,467 | B2 | 8/2012 | Lewis et al. | |
| 8,484,931 | B2 * | 7/2013 | Gleeson | E04F 19/022 52/489.1 |
| 8,596,000 | B2 | 12/2013 | Mitchell et al. | |
| 9,003,737 | B2 | 4/2015 | Solomon et al. | |
| 9,010,068 | B2 | 4/2015 | Sullivan et al. | |
| 9,169,641 | B2 * | 10/2015 | Wickstrom | E04F 13/0819 |
| 9,499,978 | B2 | 11/2016 | Shibuya | |
| 9,523,205 | B2 | 12/2016 | Vigouroux et al. | |
| D784,560 | S | 4/2017 | D'Anglade | |
| 9,635,941 | B2 | 5/2017 | Bates et al. | |
| 9,874,026 | B2 | 1/2018 | Bilge | |
| 10,011,997 | B1 | 7/2018 | Bilge | |
| 10,072,411 | B1 | 9/2018 | Moran et al. | |
| 10,267,045 | B1 | 4/2019 | Knight, Jr. et al. | |
| 10,316,525 | B1 | 6/2019 | Bilge | |
| 10,858,167 | B2 * | 12/2020 | D'Anglade | B65D 5/4283 |
| 11,098,477 | B2 * | 8/2021 | Crenshaw | E04B 1/38 |
| 2004/0211127 | A1 | 10/2004 | Wiechecki et al. | |
| 2006/0000176 | A1 | 1/2006 | Taylor | |
| 2007/0227089 | A1 | 10/2007 | Lewis et al. | |
| 2010/0095624 | A1 | 4/2010 | Lewis et al. | |
| 2012/0304568 | A1 | 12/2012 | Aboukhalil | |
| 2013/0326987 | A1 | 12/2013 | Krieger | |
| 2014/0259970 | A1 | 9/2014 | Shapiro | |
| 2015/0020468 | A1 | 1/2015 | Wickstrom | |
| 2016/0273217 | A1 | 9/2016 | Huntzinger et al. | |
| 2018/0274231 | A1 | 9/2018 | Epstein et al. | |
| 2020/0149270 | A1 * | 5/2020 | Crenshaw | E04B 1/38 |
| 2021/0372119 | A1 * | 12/2021 | Crenshaw | E04B 2/78 |
| 2021/0396020 | A1 | 12/2021 | Crenshaw | |

FOREIGN PATENT DOCUMENTS

| | | | |
|---|---|---|---|
| CN | 111101673 | A | 5/2020 |
| DE | 2650886 | A1 | 5/1977 |
| KR | 20100021852 | A | 2/2010 |
| RU | 2494198 | C1 | 9/2013 |
| WO | 2012041331 | A1 | 4/2012 |
| WO | 2017201578 | A1 | 11/2017 |

OTHER PUBLICATIONS

"Stainless Steel Walls", IntegroMed, p. 1, https://www.integromed.de/en/products/wall-system/stainless-steel.html, Last accessed Apr. 9, 2021.

"Modular Room System for Operating Theatres", Infimed, pp. 1-20, http://www.infimed.pl/zdjecia/a/zal/ot-rooms-en-2020-high_202101201158.pdf, Last accessed Apr. 9, 2021.

"Modular Walls", Skytron, pp. 1-4, https://www.skytron.com/products/architectural/modular-walls/#, Last accessed Apr. 9, 2021.

"EASE Modular Systems", Skytron, pp. 1-4, https://www.skytron.com/wp-content/uploads/documentation/Modular-Walls-Brochure-WEB.pdf, Last accessed Apr. 9, 2021.

"MEDglas™ Prefabricated OR Walls", Steris, pp. 1-7, https://www.steris.com/healthcare/products/or-environment/medglas-prefabricated-or-walls, Last accessed Apr. 9, 2021.

"Stainless steel modular walls", Vistamedikal, pp. 1-5, http://hospital-tech.com/solutions/stainless-steel-modular-walls/. Last accessed Apr. 9, 2021.

"Modular Wall System", Axis medical construction, pp. 1-4, https://www.axismedical.gr/modular-wall-system/. Last accessed Apr. 9, 2021.

"WPS-12 Stainless Steel Wall Covering", ProTek Systems Inc, pp. 1-6, https://www.proteksystem.com/product/wps-12-stainless-steel-wall-system/, Last accessed Apr. 9, 2021.

"Modular Operation Theater", Creative Health Tech Pvt. Ltd., pp. 1-5, https://www.creativemodularot.co.in/modular-operationtheater.html, Last accessed Apr. 9, 2021.

"Walling for healthcare", Altro, pp. 1-4, https://www.altro-me.com/Walls-and-doors/Sector/Healthcare, Last accessed Apr. 9, 2021.

"Drywall Handbook", Gyproc Saint-Gobain, pp. 1-44, https://www.gyproc.in/pdf/Drywall-Handbook.pdf, Last accessed Apr. 9, 2021.

Major, Maciej et al., "Effect of Steel Framing for Securing Drywall Panels on Thermal and Humidity Parameters of the Outer Walls", De Gruyter Open, vol. 13, Issue Feb. 2017, pp. 86-91, https://sciendo.com/article/10.1515/cee-2017-0011, Last accessed Apr. 9, 2021.

"Modular wall, door and ceiling system", Medifa, pp. 1-13, https://www.medifa.com/modular-room-systems/?ang=en, Last accessed Apr. 9, 2021.

Crandall, Brianna, "Metl-Span white paper lists benefits of insulated metal panels", FMLink, Jan. 18, 2016, pp. 1-3, https://www.fmlink.com/articles/metl-span-white-paper-lists-benefits-of-insulated-metal-panels/, Last accessed Apr. 9, 2021.

"Walls and ceiling panel system", Infimed, pp. 1-2, http://www.infimed.pl/en/walls-and-ceiling-panel-system,25.html, Last accessed Apr. 9, 2021.

Song, Jin-Hee et al., "Evaluation of alternatives for reducing thermal bridges in metal panel curtain wall systems", Elsevier, Energy and Buildings 127, 2016, pp. 138-158, https://www.researchgate.net/publication/303534203_Evaluation_of_Alternatives_for_Reducing_Thermal_Bridges_in_Metal_Panel_Curtain_Wall_Systems, Last accessed Apr. 9, 2021.

"Insulated metal panels installation guide", Ceco Building Systems, pp. 1-84, https://www.cecobuildings.com/wp-content/uploads/2018/10/Insulated-Panels-Installation-Manual.pdf, Last accessed Apr. 9, 2021.

Gypsum Board Assemblies, Erie Construction Council Inc, pp. 1-124, http://www.erieconstructioncouncil.com/plan_room_documents/Div%2009.pdf, Last accessed Apr. 9, 2021.

Teal, Derrick, "Insulated metal wall and roof panels for sustainability and energy efficiency", Jul. 10, 2014, pp. 1-7, https://www.slideshare.net/DerrickTeal/insulated-metal-wall-and-roof-panels-for-sustainability-and-energy-efficiency-edc1, Last accessed Apr. 9, 2021.

Non-Final Office Action dated Jun. 11, 2020 for U.S. Appl. No. 16/677,449.

Final Office Action dated Oct. 27, 2020 for U.S. Appl. No. 16/677,449.

Non-Final Office Action dated Mar. 19, 2021 for U.S. Appl. No. 16/677,449.

Final Office Action dated May 14, 2021 for U.S. Appl. No. 16/677,449.

International Search Report and Written Opinon dated May 23, 2022 for Application No. PCT/US2021/055476.

International Search Report and Written Opinion dated Jun. 1, 2022 for Application No. PCT/US2021/055564.

Invitation to Pay Additional Fees dated Feb. 2, 2022 for Application No. PCT/US2021/055476.

Non-Final Office Action dated Oct. 13, 2022 for U.S. Appl. No. 17/361,398.

Non-Final Office Action dated Oct. 18, 2022 for U.S. Appl. No. 17/361,417.

Non-Final Office Action dated Aug. 5, 2022 for U.S. Appl. No. 17/098,364.

* cited by examiner

CORNER PROTOTYPE 1

CORNER PROTOTYPE 2

CORNER ASSEMBLY

CROSS-REFERENCE TO RELATED APPLICATIONS

This application is a continuation of U.S. patent application Ser. No. 16/677,449, filed on Nov. 7, 2019, which claims priority to U.S. Provisional Application No. 62/757,610, filed on Nov. 8, 2018, each of which is hereby incorporated by reference in their entirety.

TECHNICAL FIELD

The disclosure relates generally to a corner assembly, and more specifically, to a corner assembly that encapsulates one or more panels while maintaining structural integrity and hygienic properties.

BACKGROUND

Modular panel and corner systems generally include corners that fail to encapsulate panels. Additionally, the corners may not be monolithic but may rely on caulk to seal panels together. When there are changes in field conditions or the environment in which panel and corner systems can be installed, the corners can fail to adjust to new field conditions or a new environment. When corners lack adjustability, structural integrity and/or hygienic properties can become compromised. Additionally, corners can lack a modularity and reconfiguration ability.

BRIEF DESCRIPTION OF THE DRAWINGS

For a more complete understanding of this disclosure and its features, reference is now made to the following description, taken in conjunction with the accompanying drawings, in which.

SUMMARY

Embodiments of the present disclosure may provide a monolithic corner that may provide one or more openings that may be arranged to receive a panel. The corner may include edges that may be arranged to maintain a structural integrity when panels are secured. Additionally, the corner may be made of a hygienic material that may be resistant to bacteria and other components that compromise sterility.

Other embodiments of the present disclosure may provide a provide a corner and panel system that may provide one or more openings that may be arranged to receive one or more panels. A corner in the corner and panel system may include edges that may be arranged to maintain a structural integrity when securing panels together. Additionally, a corner in the corner and panel system may be made of a hygienic material that may be resistant to bacteria and other components that compromise sterility.

Additional embodiments of the present disclosure may provide a pre-fabricated monolithic corner that may maintain structural integrity and hygienic properties.

Other technical features may be readily apparent to one skilled in the art from the following drawings, descriptions and claims.

DETAILED DESCRIPTION

Embodiments of the present disclosure may generally provide a monolithic corner that may encapsulate panels while maintaining structural integrity and hygienic properties.

Figure 1B:
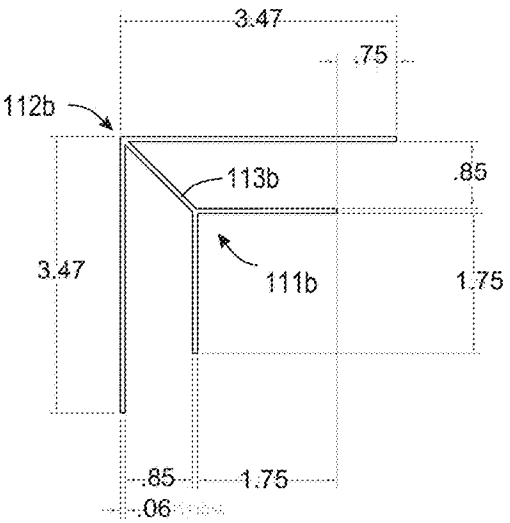
FIG. 1B depicts another corner according to an embodiment of the present disclosure.
Figure 1A:
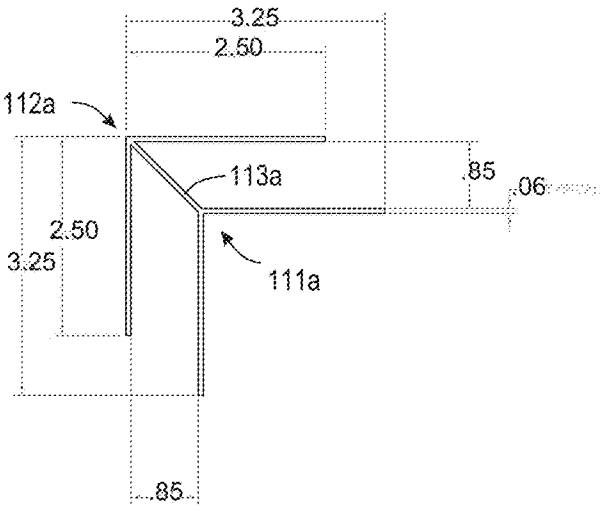
FIG. 1A depicts a corner according to an embodiment of the present disclosure.

FIGS. 1A-1B depict a monolithic corner according to an embodiment of the present disclosure. In some embodiments of the present disclosure, the corner may be pre-fabricated. It should be appreciated that the corner may be made of one or more materials including, but not limited to, extruded aluminum, stainless steel, and other materials. It should also be appreciated that the one or more materials may be sterile and may not require further sterilization for use in sensitive environments including, but not limited to, operating rooms. For example, the one or more materials may be sterile and may provide hygienic properties when used in the field, including, but not limited to, locations where access to sterile environments may be unavailable or less available. The corner may be configured to allow one or more panels and/or additional structural components to adjust or undergo modifications as desired.

The corner may be configured to encapsulate the one or more panels and may provide a solid monolithic receiver in embodiments of the present disclosure. It should be appreciated that the one or more panels may be encapsulated by sealing an entirety of an edge of the one or more panels. In some embodiments of the present disclosure, a single line of caulk may be used to seal the one or more panels to the corner. However, there may be other embodiments of the present disclosure where foam may be used in place of or in addition to the caulk. Use of foam ay add an additional layer of protection that may enhance the structural integrity of the panel and corner system.

The corner may provide a solid monolithic receiver along a plurality of edges or sides of the corner in embodiments of the present disclosure. Additionally, the corner may maintain its structural integrity and hygienic properties. The structural integrity of the corner may provide enough strength to ensure the one or more panels remain secure, regardless how the panels may be configured and/or re-configured. The hygienic properties of the corner may ensure that any configuration of corners and the one or more panels will be sterile and safe for sensitive environments including, but not limited to, hospitals, clean rooms, pharmacies, cafeteria, sterile processing department, radiological environments, operating rooms, and other environments or settings.

A pre-fabricated monolithic corner may provide flexibility to adjust a connected panel or plurality of panels for any room size according to an embodiment of the present disclosure. It should be appreciated that the connected panel or plurality of panels may have a finish that may be stainless steel. It should also be appreciated that the connected panel or plurality of panels may have a finish that may be galvanized, powder-coated, or not powder-coated. However, other types of finishes and/or coatings and combinations of the same may be used without departing from the present disclosure.

In some embodiments of the present disclosure, the connected panel or the plurality of panels may have a standard size. In such instances, the connected panel or the plurality of panels may each utilize the same solid monolithic receiver that may be provided by the corner. However, the solid monolithic receiver provided by the corner may be provided in different sizes and/or thicknesses to receive panels having different sizes in embodiments of the present disclosure.

A corner and panel system may include a pre-fabricated monolithic corner that may provide an opening to receive the panel according to an embodiment of the present disclosure. The opening may also be referred to as a throat and may be provided in a plurality of sizes to receive different types, sizes, and/or thicknesses of panels in embodiments of the present disclosure. It should be appreciated that a depth of the throat may be plus or minus approximately one millimeter in some embodiments of the present disclosure and may effectively seal the panel without use of a caulk or foam; however, caulk and/or foam may be used without departing from the present disclosure.

It should be appreciated that corners may have inner dimensions that may be approximately 3.25 inches by 3.25 inches. It should be appreciated that corners may have inner dimensions more or less than 3.25 inches without departing from the present disclosure. It should be appreciated that corners may have outer dimensions that may be approximately 2.5 inches by 2.5 inches. It should be appreciated that corners may have outer dimensions that may be more or less than approximately 2.5 inches without departing from the present disclosure. As shown in FIG. 1A, the corner can include a front corner face 111A, a back corner face 112A, and a middle wall 113A.

It, should be appreciated that corners may have inner dimensions that may be approximately 1.75 inches by 1.75 inches. It should be appreciated that corners may have inner dimensions more or less than 1.75 inches without departing from the present disclosure. It should be appreciated that corners may have outer dimensions that may be approximately 3.47 inches by 3.47 inches. It should be appreciated that corners may have outer dimensions that may be more or less than approximately 3.47 inches without departing from the present disclosure. As shown in FIG. 1B, the corner can include a front corner face 111B, a back corner face 112B, and a middle wall 113B.

Figure 2B:
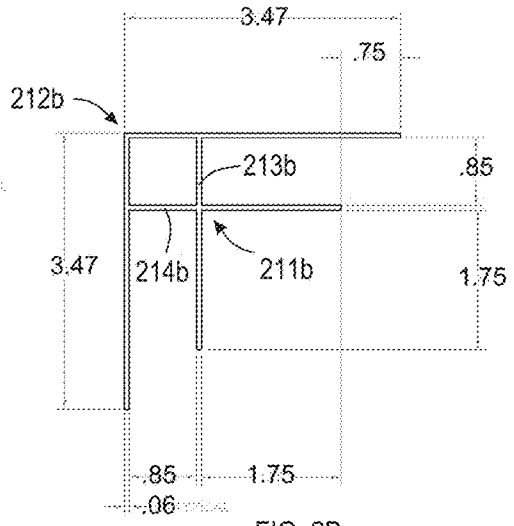
FIG. 2B depicts a corner according to an embodiment of the present disclosure.
Figure 2A:
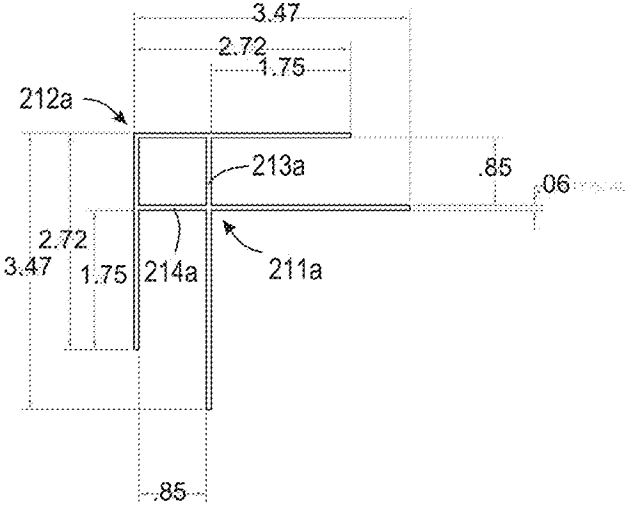
FIG. 2A depicts an additional corner according to an embodiment of the present disclosure.

It should be appreciated that corners may have inner dimensions that may be approximately 3.47 inches by 3.47 inches. It should be appreciated that corners may have inner dimensions more or less than approximately 3.47 inches without departing from the present disclosure. It should be appreciated that corners may have outer dimensions that may be approximately 1.75 inches by 1.75 inches. It should be appreciated that corners may have outer dimensions that may be more or less than approximately 1.75 inches without departing from the present disclosure. As shown in FIG. 2A, the corner can include a front corner face 211A, a back corner face 212A, a first middle wall 213A, and a second middle wall 214A. As shown in FIG. 2B, the corner can include a front corner face 211B, a back corner face 212B, a first middle wall 213B, and a second middle wall 214B.

It should be appreciated that corners may have inner dimensions that may be approximately 3.47 inches by 3.47 inches. It should be appreciated that corners may have inner dimensions more or less than approximately 3.47 inches without departing from the present disclosure. It should be appreciated that corners may have outer dimensions that may be approximately 1.75 inches by 1.75 inches. It should be appreciated that corners may have outer dimensions that may be more or less than approximately 1.75 inches without departing from the present disclosure.

It should be appreciated that a space measuring approximately 0.85 inches may separate an outer component from an inner component of corners that may be provided to receive a panel. It should be appreciated that the space may be an opening or a throat. It should also be appreciated that a thickness of corner components may be approximately 0.06 inches without departing from the present disclosure. It should further be appreciated that the space, opening, throat, and thickness may be any dimension without departing from the present disclosure.

It may be advantageous to set forth definitions of certain words and phrases used in this patent document. The terms "include" and "comprise," as well as derivatives thereof, mean inclusion without limitation. The term "or" is inclusive, meaning and/or. The phrases "associated with" and "associated therewith," as well as derivatives thereof may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A corner assembly for a wall system configured to be installed as part of a hygienic hospital environment, the corner assembly comprising:

a first leg intersecting a second leg at a back corner face, the first leg having a first length and a first end, the second leg having a second length and a second end, and the first leg and the second leg each formed of a hygienic material resistant to bacteria;

a third leg intersecting a fourth leg at a front corner face, the third leg having a third length and a third end, the fourth leg having a fourth length and a fourth end, a first difference between the first end of the first leg and the third end of the third leg is approximately 0.75 inches, a second difference between the second end of the second leg and the fourth end of the fourth leg is approximately 0.75 inches, and the third leg and the fourth leg each formed of the hygienic material; and a plurality of openings arranged and sized to receive a plurality of panels, the plurality of openings comprising:

a first opening defined between a first planar surface of the first leg and a third planar surface of the third leg that faces the first planar surface, the first opening is arranged and sized to receive a first panel of the plurality of panels, and a second opening defined between a second planar surface of the second leg and a fourth planar surface of the fourth leg that faces the second planar surface, the second opening is arranged and sized to receive a second panel of the plurality of panels.

2. The corner assembly of claim 1, wherein the hygienic material is extruded aluminum.

3. The corner assembly of claim 1, wherein the hygienic material is stainless steel.

4. The corner assembly of claim 1, wherein the first panel is adjustable when received in the first opening and the second panel is adjustable when received in second opening.

5. The corner assembly of claim 1, wherein the front corner face consists of a first front planar surface of the third leg and a second front planar surface of the fourth leg intersecting the first front planar surface of the third leg.

6. The corner assembly of claim 1, further comprising:

a first middle wall intersecting each of the first leg and the third leg perpendicularly; and a second middle wall intersecting each of the second leg and the fourth leg perpendicularly.

7. The corner assembly of claim 1, wherein each of the first panel and the second panel comprises a stainless steel finish or a powder-coating finish.

8. The corner assembly of claim 1, wherein each of the first panel and the second panel comprises a galvanized finish.

9. The corner assembly of claim 1, wherein the corner assembly comprises a powder-coating finish.

10. The corner assembly of claim 1, wherein the corner assembly comprises a galvanized finish.

11. A corner and panel system for a wall system configured to be installed as part of a hygienic hospital environment, the corner and panel system comprising:

a corner assembly comprising:

a first leg intersecting a second leg at a back corner face, the first leg having a first length and the second leg having a second length, a third leg intersecting a fourth leg at a front corner face, the third leg having a third length and the fourth leg having a fourth length, the first length is shorter or longer than the third length, and the second length is shorter or longer than the fourth length, and a plurality of openings arranged and sized to receive a plurality of panels, the plurality of openings comprising:

a first opening defined by the first leg and the third leg, the first opening is arranged and sized to receive a first panel of the plurality of panels, and the first panel is adjustable when received in the first opening, and a second opening defined by the second leg and the fourth leg, the second opening is arranged and sized to receive a second panel of the plurality of panels, and the second panel is adjustable when received in the first opening.

12. The corner and panel system of claim 11, wherein an edge of the first panel is sealed by the first leg and the third leg, and an edge of the second panel is sealed by the second leg and the fourth leg.

13. A corner assembly configured to be installed as part of a hygienic hospital environment, the corner assembly comprising:

a first leg intersecting perpendicularly a second leg at a back corner face to form a first right-angle interface at the back corner face, and the first leg and the second leg each formed of a hygienic material resistant to bacteria;

a third leg intersecting perpendicularly a fourth leg at a front corner face to form a second right-angle interface at the front corner face, and the third leg and the fourth leg each formed of the hygienic material; and a plurality of openings arranged and sized to receive a plurality of panels, the plurality of openings comprising:

a first opening defined between a first planar surface of the first leg and a third planar surface of the third leg that faces the first planar surface, the first opening is arranged and sized to receive a first panel of the plurality of panels, and the first panel is adjustable when received in the first opening, and a second opening defined between a second planar surface of the second leg and a fourth planar surface of the fourth leg that faces the second planar surface, the second opening is arranged and sized to receive a second panel of the plurality of panels, and the second panel is adjustable when received in the second opening.

14. The corner assembly of claim 13, wherein the first opening is arranged and sized to receive the first panel such that an entirety of an edge of the first panel is sealed by the first leg and the third leg, and the second opening is arranged and sized to receive the second panel such that an entirety of an edge of the second panel is sealed by the second leg and the fourth leg.

15. The corner assembly of claim 13, wherein a single line of caulk is used to seal the second panel to the corner assembly.

16. The corner assembly of claim 13, wherein foam is used to seal the second panel to the corner assembly.

17. The corner assembly of claim 13, wherein the corner assembly comprises a powder-coating finish.

18. The corner assembly of claim 13, wherein a first length of the first leg is shorter or longer than a third length of the third leg, and a second length of the second leg is shorter or longer than a fourth length of the fourth leg.

19. The corner assembly of claim 13, wherein the front corner face consists of a first front planar surface of the third leg and a second front planar surface of the fourth leg intersecting the first front planar surface of the third leg.

20. The corner assembly of claim 13, further comprising:

a first middle wall intersecting each of the first leg and the third leg perpendicularly; and a second middle wall intersecting each of the second leg and the fourth leg perpendicularly.

* * * * *